US008033273B2

(12) United States Patent
Kato et al.

(10) Patent No.: US 8,033,273 B2
(45) Date of Patent: Oct. 11, 2011

(54) PLASMA IGNITION SYSTEM

(75) Inventors: Hideyuki Kato, Nishio (JP); Tohru Yoshinaga, Okazaki (JP); Masamichi Shibata, Toyota (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 18 days.

(21) Appl. No.: 12/164,858

(22) Filed: Jun. 30, 2008

(65) Prior Publication Data

US 2009/0007893 A1 Jan. 8, 2009

(30) Foreign Application Priority Data

Jul. 2, 2007 (JP) ..... 2007-173745
May 7, 2008 (JP) ..... 2008-120919

(51) Int. Cl.
*F02P 3/06* (2006.01)
*F02P 7/06* (2006.01)

(52) U.S. Cl. ..... 123/596; 123/633
(58) Field of Classification Search ..... 123/596, 123/620, 633
See application file for complete search history.

(56) References Cited

U.S. PATENT DOCUMENTS 3,516,396 A * 6/1970 Lawson, Jr. ..... 123/648
4,078,534 A * 3/1978 Mayer ..... 123/633
4,219,707 A * 8/1980 Sawada et al. ..... 200/19.39
4,308,488 A 12/1981 Imai et al.
4,327,702 A * 5/1982 Imai et al. ..... 123/620
4,337,408 A * 6/1982 Sone et al. ..... 313/130
4,369,758 A * 1/1983 Endo ..... 123/620
4,396,855 A * 8/1983 Imai et al. ..... 313/139
4,510,915 A * 4/1985 Ishikawa et al. ..... 123/620
5,027,764 A * 7/1991 Reimann ..... 123/143 B
5,078,627 A * 1/1992 Anderson ..... 440/1
5,207,186 A * 5/1993 Okita ..... 123/41.31
6,501,360 B2 12/2002 Martagni et al.
6,553,981 B1 4/2003 Suckewer et al.
6,679,235 B1 * 1/2004 Skinner et al. ..... 123/620
6,857,420 B2 2/2005 Weimert (Continued)

FOREIGN PATENT DOCUMENTS

EP 515594 A2 3/2005

(Continued)

OTHER PUBLICATIONS

EP Extended Search Report issued Oct. 17, 2008 in corresponding EP Patent Application No. 08159384.0.

(Continued)

*Primary Examiner* — Erick Solis
*Assistant Examiner* — Sizo Vilakazi
(74) *Attorney, Agent, or Firm* — Nixon & Vanderhye PC

(57) ABSTRACT

A plasma ignition system includes an ignition plug attached to an engine and having a center electrode, a ground electrode, and a discharge space, a discharge power source circuit, a plasma generation power source circuit, a resistance element between the discharge power source circuit and the center electrode, a rectifying device between the plasma generation power source circuit and the center electrode, and an element receiving portion in a periphery of the center electrode. The plug puts gas in the discharge space into a plasma state to ignite a fuel/air mixture in the engine, as a result of application of high voltage to the plug by the discharge power source circuit and supply of high current to the plug by the plasma generation power source circuit. The resistance element and the rectifying device are placed in the receiving portion.

17 Claims, 12 Drawing Sheets

U.S. PATENT DOCUMENTS

| | | | | |
|---|---|---|---|---|
| 7,036,495 | B1 | 5/2006 | Shimizu | |
| 7,387,115 | B1 | 6/2008 | Katoh et al. | |
| 2007/0114901 | A1* | 5/2007 | Nagasawa et al. | 313/141 |

FOREIGN PATENT DOCUMENTS

| | | |
|---|---|---|
| JP | 55-156263 | 11/1980 |
| JP | 55-172658 | 12/1980 |
| JP | 56-56965 | 5/1981 |
| JP | 56-165391 | 12/1981 |
| JP | 57-2586 | 1/1982 |
| JP | 57-164265 | 10/1982 |
| JP | A-60-98167 | 1/1985 |

OTHER PUBLICATIONS

Japanese Office Action dated May 26, 2009, issued in corresponding Japanese Application No. 2008-120919, with English translation.

* cited by examiner

PLASMA IGNITION SYSTEM

CROSS REFERENCE TO RELATED APPLICATION

This application is based on and incorporates herein by reference Japanese Patent Application No. 2007-173745 filed on Jul. 2, 2007 and Japanese Patent Application No. 2008-120919 filed on May 7, 2008.

BACKGROUND OF THE INVENTION

1. Field of the Invention

The present invention relates to measures to prevent leakage of electromagnetic wave noise in a plasma ignition system, which is used for ignition in an internal combustion engine.

2. Description of Related Art

Recently, from a standpoint of environmental protection, lean mixture combustion or supercharged mixture combustion, for example, is required in an internal combustion engine to reduce emissions in combustion exhaust gas or to improve fuel mileage, so that an ignition condition is becoming severe. Accordingly, an ignition system, in which stable ignitionability is achieved, is required in an engine of poor ignitionability.

In the case of ignition of the engine, an ignition system using an ordinary spark plug 10*z* shown in FIG. 10A includes a battery 31*z*, an ignition switch 32*z*, an ignition coil 33*z*, an electronic control unit (ECU) 35*z*, an ignition coil drive circuit (transistor) 34*z*, a rectifying device 21*z*, and the spark plug 10*z*. As shown in FIG. 10B, when the ignition switch 32*z* is thrown, a primary voltage having a low voltage is applied to a primary coil 331*z* of an ignition coil 33*z* from the battery 31*z* in response to an ignition signal from the ECU 35*z*. Subsequently, when the primary voltage is cut off through the switching of the ignition coil drive circuit 34*z*, a magnetic field in the ignition coil 33*z* changes, and thereby a secondary voltage in a range of −10 to −30 kV is generated in a secondary coil 332*z* of the ignition coil 33*z*. As a result, electric discharge takes place in a center electrode 110*z* and a ground electrode 131*z*, and accordingly a high-temperature region is generated in a small area. In the case of the ignition by the ordinary spark plug 10*z*, the above high-temperature region serves as a source of ignition to excite ignition and explosion of a compressed air-fuel mixture. Meanwhile, a current of about 35 mA rectified through a diode 21*z* passes through the secondary coil 332*z* during a conducting period of about 2 ms, which is a relatively long duration, and energy of about 35 mJ is released to the spark plug 10*z*.

In the case of ignition by a plasma ignition system 1*x* shown in FIG. 12A, when an ignition switch 31*x* is thrown (see FIG. 12B), a primary voltage having a low voltage is applied to a primary coil 321 of an ignition coil 32*x* from a discharge battery 30*x*. By switching of an ignition coil drive circuit (transistor) 33*x* controlled by an electronic control unit (ECU) 34*x*, the primary voltage is cut off and thereby a magnetic field in the ignition coil 32*x* changes. Consequently, a secondary voltage in a range of −10 to −30 xV is generated in a secondary coil 322*x* of the ignition coil 32*x*. The insulation in a discharge space 140*x* breaks down and electric discharge is started when the secondary voltage reaches a discharge voltage proportional to a discharging gap in the discharge space 140*x* formed between a center electrode 110*x* and a ground electrode 130*x*. Meanwhile, energy (e.g., −450V, 120 A) stored in a capacitor 42*x* from a plasma energy supply battery 40*x*, which is provided separately from the discharge battery 30*x*, is released to the discharge space 140*x* at once. Accordingly, gas in the discharge space 140*x* enters into a high-temperature and pressure plasma state, and is injected through an opening 132*x* formed at a leading end of the discharge space 140*x*. As a result, a very high temperature range in a range of thousands to tens of thousands of degrees Celsius and having great directivity is generated in a wide range of volume. Thus, such a plasma ignition system is expected to be applied to an ignition system in an internal combustion engine of difficult ignitionability in which lean mixture combustion or supercharged mixture combustion, for example, is performed. In addition, when the plasma ignition system is applied to the ordinary spark plug, plasma having high energy is generated between electrodes of the plug. Therefore, improvement in ignitionability is expected.

However, in the conventional plasma ignition system Ix, the energy stored in the capacitor 42*x* for plasma generation is instantaneously supplied to a plasma ignition plug 10*x*. Consequently, as shown in FIG. 12B, a high current of about 120 A is passed for a conducting period of about 8 μsec, which is an extremely short duration. Since the above passing of high current is periodically repeated according to rotation of the engine, an electromagnetic wave noise of high frequency is generated. Malfunction of the electronic control unit installed in a vehicle or the like is caused by such an electromagnetic wave noise, and as a result, an accidental fire of the engine may be caused. As a method for preventing the above electromagnetic wave noise, a method for blocking the electromagnetic wave noise is disclosed in JP55-172659U corresponding to U.S. Pat. No. 4,327,702. The electromagnetic wave noise is blocked, by using a shielding wire for a wiring for plasma generation connecting a plasma generation power source and a plug, giving an electromagnetic wave shield to cover the whole plug, and using a resistance wire for a wiring for electric discharge connecting an electric discharge power source and the plug.

Nevertheless, the internal combustion engine such as a car motor usually includes a plurality of cylinders, and accordingly, the electromagnetic wave shield needs to be given over a very wide range when the conventional method illustrated in JP55-172659U is employed. In a plasma ignition system, in which a plurality of plasma ignition plugs 10*x* (1), 10*x* (2), 10*x* (3), 10*x* (4) is connected to an ignition coil 32*x* via a distributor 60*x*, as shown in FIG. 11, when a shielding wire is used for a plasma generation wiring 400*x* connected to each plug, the whole plug is covered with an electromagnetic wave shield, and a resistance wire 36*x* is used for a high voltage supply wiring, in order to restrict the generation of the electromagnetic wave noise, stray capacitances Cs (1 to 6) in electromagnetic wave shield parts Sd (1 to 6) are not constant since the length of each shielding wire differs. Accordingly, it is difficult to maintain an earth potential of each electromagnetic wave shield part at the same electric potential, and thereby an electric potential difference is generated between the electromagnetic wave shields. Such an electric potential difference serves as a generation source of a new electromagnetic wave noise. Also, electric field concentration is generated in a connection part of each electromagnetic wave shield part, and it is difficult to block the electromagnetic wave noise completely.

In addition, a transmit circuit is formed from the ignition coil 32*x* and the plasma ignition plug 10*x* as a discharging space. When high voltage is applied from the ignition coil 32*x* and electric discharge is started, the electromagnetic wave noise is generated and may leak to the outside because a plasma generation wiring connecting a center-electrode terminal area 112*x* and the capacitor 42*x* for plasma generation serves as an antenna. In the ordinary spark plug, such transmission of the electromagnetic wave noise is prevented by interposing a resistance element between the ignition coil and the plug. However, as mentioned above, the high current must be passed through the plasma generation wiring. Thus, the electromagnetic wave noise at the time of starting of the electric discharge cannot be absorbed by interposing the resistance element on the plasma generation wiring.

SUMMARY OF THE INVENTION

The present invention addresses the above disadvantages. Thus, it is an objective of the present invention to provide a plasma ignition system, which is easily installed and has an excellent effect of preventing an emission of an inevitably generated electromagnetic wave noise to an outside, in a plasma ignition system.

To achieve the objective of the present invention, there is provided a plasma ignition system for an internal combustion engine. The system includes an ignition plug, a discharge power source circuit, a plasma generation power source circuit, a resistance element, a rectifying device, and an element receiving portion. The ignition plug is attached to the engine and has a center electrode, a ground electrode, and a discharge space, which is formed between the center electrode and the ground electrode. The discharge power source circuit is configured to apply a high voltage to the ignition plug. The plasma generation power source circuit is configured to supply a high current to the ignition plug. The ignition plug is configured to put gas in the discharge space into a plasma state having high temperature and pressure thereby to ignite a fuel/air mixture in the engine, as a result of the application of the high voltage to the ignition plug by the discharge power source circuit and the supply of the high current to the ignition plug by the plasma generation power source circuit. The resistance element is disposed between the discharge power source circuit and the center electrode. The rectifying device is disposed between the plasma generation power source circuit and the center electrode. The element receiving portion is disposed in a periphery of the center electrode. The resistance element and the rectifying device are placed in the element receiving portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
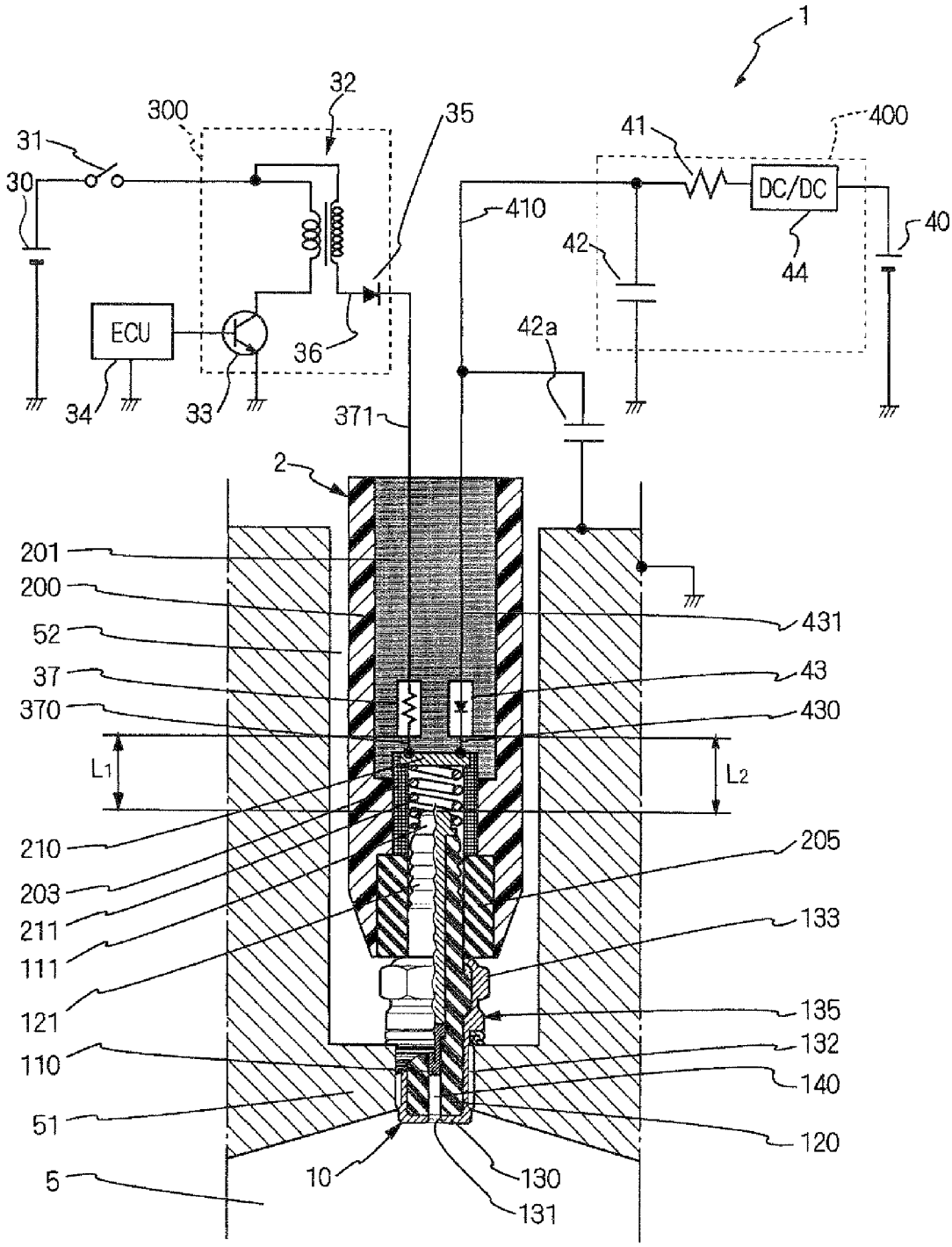
FIG. 1 is a sectional view illustrating a configuration of a main portion of a plasma ignition system according to a first embodiment of the invention.

A first embodiment of the invention is described below with reference to FIG. 1. As shown in FIG. 1, a plasma ignition system 1 according to the first embodiment includes a plasma ignition plug 10, power sources 30, 40, a discharge power source circuit 300, a plasma generation power source circuit 400, an element receiving portion 2, and an electronic control unit (ECU) 34.

The discharge power source circuit 300 is connected to the power source 30, and includes an ignition switch 31, an ignition coil 32, an ignition coil drive circuit 33, which drives the ignition coil 32 in response to a ignition command from the external ECU 34, and a rectifying device 35, which rectifies a discharge current. The plasma generation power source circuit 400 is connected to the power source 40, and includes a DC/DC converter 44, a resistance 41, and plasma generation capacitors 42, 42*a*.

The ignition coil drive circuit 33 includes a transistor, which is controlled to be opened and closed by the external ECU34 formed outside, and controls the supply of a high voltage, which is generated as a result of increasing a voltage from the power source 30 by the ignition coil 32, to the plasma ignition plug 10.

The rectifying device 35, which rectifies the discharge current, rectifies the high voltage from the ignition coil 32 and prevents a backflow of a high current from the plasma generation capacitor 42. The ignition coil 32 and the rectifying device 35 are connected by a high resistance line 36. A resistance element 37 is located in a position, which is as close as possible to a center electrode 110 between the rectifying device 35 and the center electrode 110, in other words, the resistance element 37 is positioned such that a downstream side discharge delivery line 370 between the resistance element 37 and a center electrode terminal part 111 is made as short as possible.

The plasma generation capacitor 42 is charged by the power source 40, and emits a high current to the plasma ignition plug 10 at the time of electric discharge.

A rectifying device 43, which rectifies a plasma current, is located such that a downstream side high current delivery line 430 between the device 43 and the center electrode terminal part 111 is made as short as possible. The rectifying device 43 rectifies a high current from the plasma generation capacitor 42, and prevents a backflow of discharge voltage from the ignition coil 32.

The plasma ignition plug 10 includes the columnar center electrode 110, which is made of a conductive metal material, a cylindrical insulating member 120, which insulates and holds the center electrode 110, and a ground electrode 130, which is made of cylindrical metal and covers the insulating member 120.

A leading end side of the center electrode 110 is formed in the shape of an extended shaft from a conductive material such as iridium or iridium alloy. A center electrode axis, which is formed from a metallic material having good electric conductivity and high thermal conductivity, such as a ferrous material or copper, is formed inside the center electrode 110. The center electrode terminal part 111 is formed on a rear end side of the center electrode 110.

A ground electrode opening 131 is formed at a lower end of the ground electrode 130, and a threaded portion 132 for screwing the ground electrode 130 to an engine block 51 is formed on an outer surface of the ground electrode 130. A housing part 135, which receives and holds the insulating member 120, is formed on a rear end side of the ground electrode 130, and a hexagonal part 133 for screwing the threaded portion 132 to the engine block 51 is formed on an outer circumference of the housing 135. The housing 135 including the ground electrode 130 is formed from a metallic material such as nickel or iron.

A discharge space 140 is formed inside the insulating member 120, and electricity is discharged between the center electrode 110 and the ground electrode 130. The insulating member 120 is formed from, for example, highly-pure alumina, which is excellent in heat resistance, mechanical strength, dielectric strength at high temperature, and heat conductivity. A rear end side of the insulating member 120 has an insulating member head portion 121, which electrically insulates the center electrode terminal part 111 from the housing 135.

The plasma ignition plug 10 is attached in a plug hole 52 formed in the engine block 51 such that a leading end of the plasma ignition plug 10 is exposed to the inside of a combustion chamber 5, which is defined by the engine block 51 and a cylinder block of an internal combustion engine (not shown). In addition, the ground electrode 130 is electrically grounded to the engine block 51.

The element receiving portion 2, which is a main portion of the invention, receives the resistance element 37 and the rectifying device 43 as elements. The element receiving portion 2 includes a part of an upstream side discharge delivery line 371, the downstream side discharge delivery line 370, upstream side high current delivery lines 410, 431, the downstream side high current delivery line 430, a spring electrode 211, insulating resin moldings 200, 201, 203, and an insulated part 205. The upstream side discharge delivery line 371 connects the discharge power source circuit 300 and the resistance element 37 on an upstream side of the resistance element 37. The downstream side discharge delivery line 370 connects the resistance element 37 and a common electrode 210 on a downstream side of the resistance element 37. The upstream side high current delivery lines 410, 431 connect the plasma generation power source circuit 400 and the rectifying device 43 on an upstream side of the rectifying device 43. The downstream side high current delivery line 430 connects the rectifying device 43 and the common electrode 210 on a downstream side of the rectifying device 43. The spring electrode 211 connects the common electrode 210 and the center electrode terminal part 111. The insulating resin moldings 200, 201, 203 are made of, for example, epoxy resins, and cover the resistance element 37, the rectifying device 43, the spring electrode 211 and the like. The insulated part 205 is formed in a cylindrical shape from an elastic member so as to be attached on the insulating member head portion 121 of the plasma ignition plug 10. The element receiving portion 2 is received in the plug hole 52 of the engine block 51 to generally block an opening of the plug hole 52.

The downstream side discharge delivery line 370, the downstream side high current delivery line 430, the common electrode 210, and the spring electrode 211 may preferably be arranged such that a distance L1 from a lower end surface of the resistance element 37 to the center electrode terminal part 111 and a distance L2 from the lower end surface of the rectifying device 43 to the center-electrode terminal part 111 are made as small as possible, in order to make as small as possible a stray capacitance formed between the element receiving portion 2 and a peripheral wall of the plug hole 52 from the resistance element 37 to an upper end surface of the center electrode terminal part 111, and a stray capacitance formed between the receiving portion 2 and the peripheral wall of the plug hole 52 from the rectifying device 43 to the upper end surface of the center electrode terminal part 111.

Figure 2:
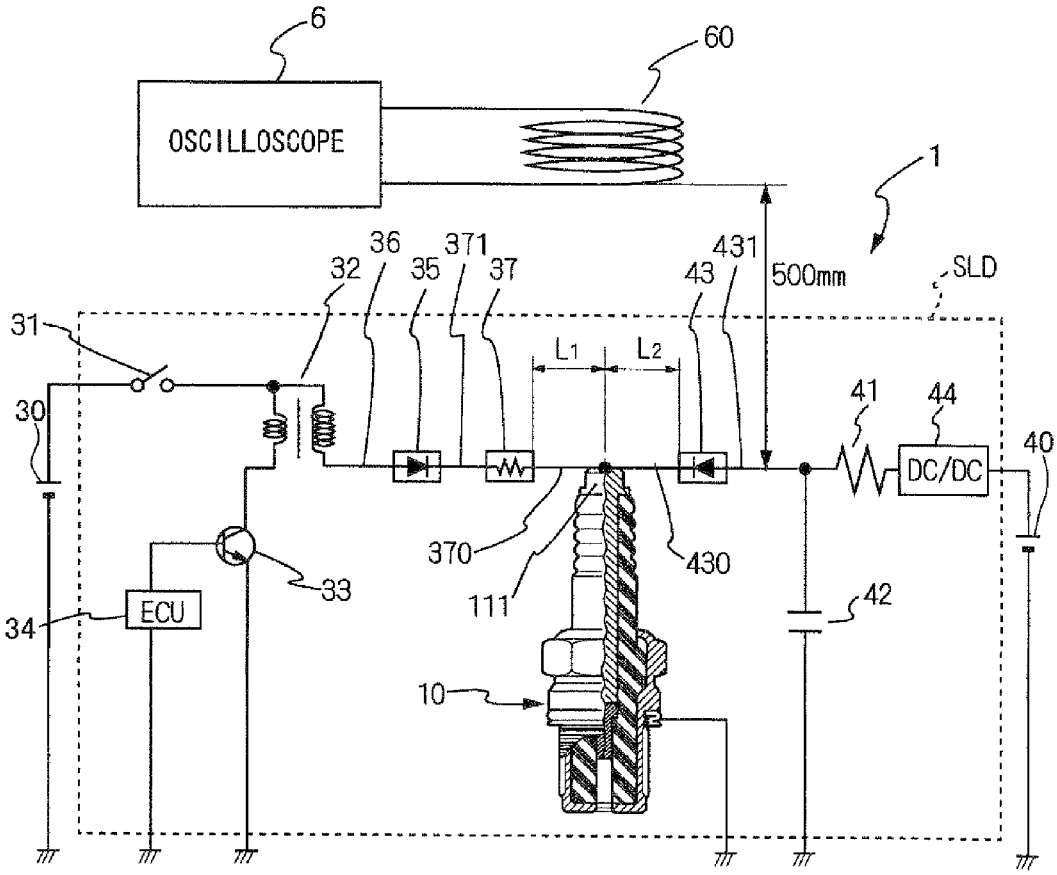
FIG. 2 is a diagram illustrating a method for evaluating the plasma ignition system according to the first embodiment.

FIG. 2 is a schematic diagram illustrating a method for measuring an electromagnetic-wave noise generated in the plasma ignition system 1 of the first embodiment. As shown in FIG. 2, a noise detection coil 60 (ϕ 82 mm, 20 T) is provided with a predetermined distance maintained from the plasma ignition system 1, and a maximum width P−Pmax (V) of a radio noise is measured after measuring the noise ten times by an oscilloscope 6. The maximum width P−Pmax (V) is measured with respect to embodiments, in which the distance L1 from the resistance element 37 to the upper end surface of the center electrode terminal part 111, and the distance L2 from the rectifying device 43 to the upper end surface of the center electrode terminal part 111 are varied, and comparative examples, in which the resistance element 37 is not provided, under the conditions shown in Table 1. In addition, a short dashes line SLD in FIG. 2 indicates an electromagnetic shielding in the first embodiment, in which almost all the circuits are placed in the plug hole (PH) 52.

TABLE 1

| | 1st condition | 2nd condition | 3rd condition |
|---|---|---|---|
| 1st embodiment | L1 varied | L2 fixed | disposed in PH |
| 2nd example | L1 fixed | L2 varied | |
| 3rd example | L1 varied | L2 fixed | |
| 1st comparative example | No resistance element | | |
| 2nd comparative example | No resistance element | L1 varied | |
| 3rd comparative example | No resistance element | | disposed in PH |

Figure 3:
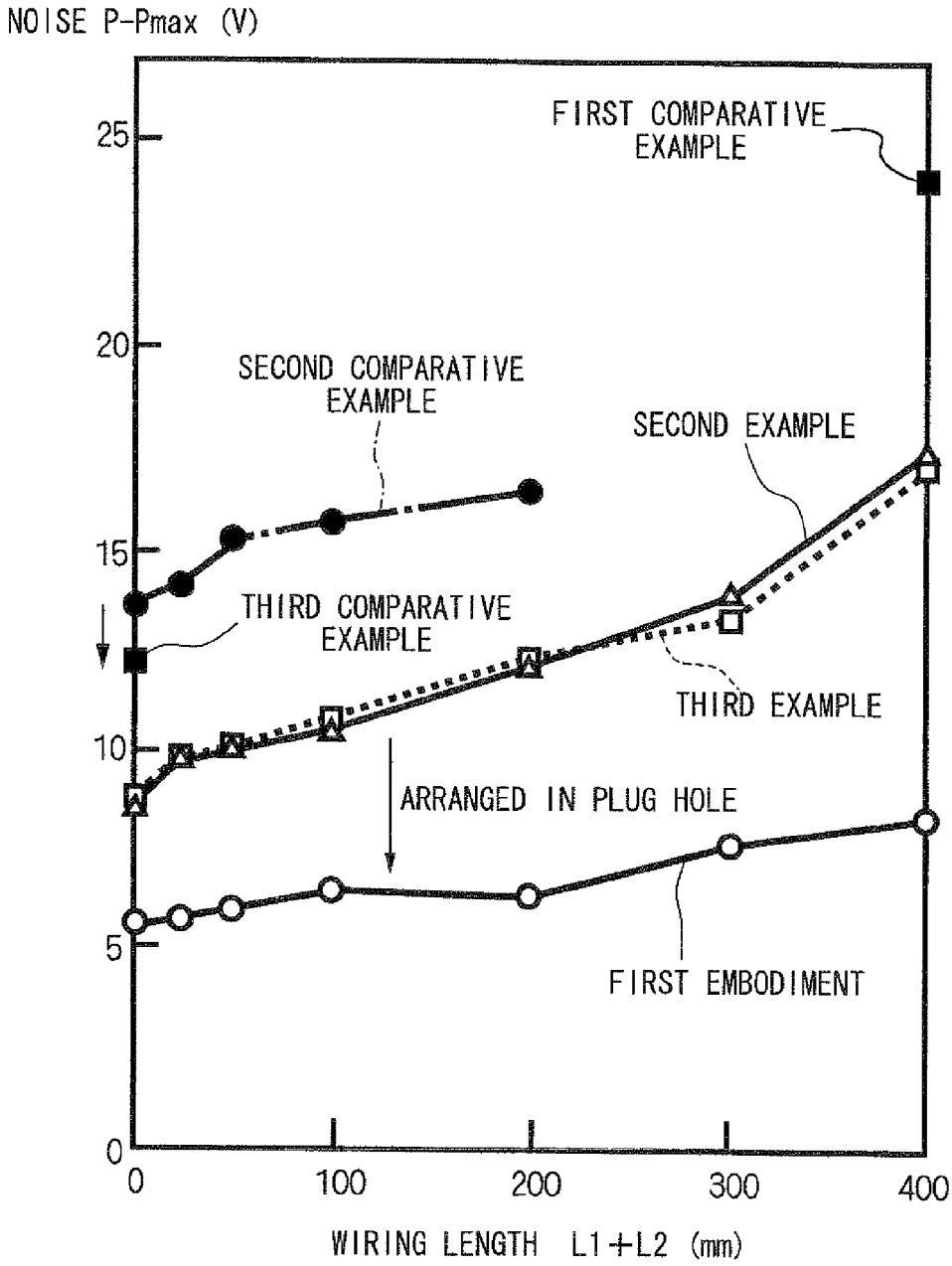
FIG. 3 is a characteristics graph illustrating an advantageous effect of the plasma ignition system according to the first embodiment together with comparative examples.

FIG. 3 shows an advantageous effect of the invention together with comparative examples. As shown in FIG. 2, the first embodiment shows the noise reduction effect when L2 is fixed at 3 mm and L1 is varied in an embodiment of the invention, in which all the circuits are received in the plug hole 52 to use the engine block 51 as a shield (SLD) and which produces the strongest noise reduction effect. In FIG. 3, a vertical axis shows a noise level and a horizontal axis shows a total length of L1 and L2. A second example shows the noise reduction effect when the resistance element 37 and the rectifying device 43 are positioned outside the plug hole 52, and L1 is fixed and L2 is varied. A third example shows the noise reduction effect when the resistance element 37 and the rectifying device 43 are positioned outside the plug hole 52, and L2 is fixed and L1 is varied. A first comparative example shows a state of the electromagnetic-wave noise in a conventional plasma ignition system, in which the resistance element 37 is not provided and a discharge power source and a center electrode are connected by a resistance wire. A second comparative example shows the noise reduction effect when L2 is fixed and L1 is varied, in a conventional plasma ignition system, in which the resistance element 37 is not provided and a discharge power source and a center electrode are connected by a resistance wire. The length of L1 when the conventional plasma ignition system does not include the resistance element 37 is a distance between the rectifying device 35 and the center electrode terminal part 111. A third comparative example shows the noise reduction effect when the whole circuit is placed in the plug hole 52 in a conventional plasma ignition system, in which the resistance element 37 is not provided and a discharge power source and a center electrode are connected by a resistance wire.

As shown in FIG. 3, results of the second and third examples show that the noise reduction effect when the resistance element 37 and the rectifying device 43 are placed in the periphery of the center electrode terminal part 111 is generally the same in both the examples, and that the electromagnetic noise increases when one of L1 and L2 becomes large. Furthermore, it is shown that the noise level is smaller as the total distance of L1 and L2 becomes smaller. Also when the rectifying device 35 is placed in the periphery of the center electrode terminal part 111, it is shown that the noise reduction effect is enhanced as the distance L1 from the rectifying device 35 to the center electrode terminal part 111 becomes smaller. Moreover, it is shown that the electromagnetic wave noise is reduced most effectively when as many of the elements as possible are received in the element receiving portion 2, which is in turn placed in the plug hole 52. In addition, when the resistance element 37 and the rectifying device 43 are arranged side by side with each other in the plug hole 52, the wiring lengths of L1 and L2 are most shortened, so that the noise reduction effect is expected to be further enhanced. When the resistance element 37 and the rectifying device 43 are shifted up and down from each other, the total length of L1 and L2 becomes geometrically longer than when the resistance element 37 and the rectifying device 43 are arranged side by side. As a result, the noise may be increased.

The distance L1 from the lower end of the resistance element 37 to the upper end of the center electrode 110 may preferably be set at 30 mm or less.

It is shown that the electromagnetic noise is reduced most effectively by arranging the resistance element 37 as above. Therefore, in the internal combustion engine having great ignition resistance, ignition by the plasma ignition system 1 is further stabilized.

The distance L2 from the lower end of the rectifying device 43 to the upper end of the center electrode 110 may preferably be set at 30 mm or less.

It is shown that the electromagnetic noise is reduced even more effectively by arranging the rectifying device 43 as above. Therefore, in the internal combustion engine having great ignition resistance, ignition by the plasma ignition system 1 is further stabilized.

As a result of the above measurement, it is shown that the electromagnetic wave noise is reduced more effectively by setting the distance L1 between the lower end of the resistance element 37 and the upper end of the center electrode terminal part 111 preferably at 30 mm or less, and setting the distance L2 between the rectifying device 43 and the upper end of the center electrode terminal part 111 preferably at 30 mm or less. The total distance (L1+L2) of the distance L1 from the lower end of the resistance element 37 to the upper end of the center electrode 110 and the distance L2 from the lower end of the rectifying device 43 to the upper end of the center electrode 110 may preferably be set at 30 mm or less. As a result, the electromagnetic-wave noise turns out to be further reduced. Therefore, in the internal combustion engine having great ignition resistance, ignition by the plasma ignition system 1 is further stabilized. When the elements are received in the element receiving portion 2 such that the lengths of L1 and L2 are small, the noise is reduced. In addition, as described above, by disposing the element receiving portion 2 in the plug hole 52, the noise reduction effect is enhanced.

When the engine head 51, which defines the plug hole 52, is made of a shielding material, the engine head 51 is expected to have an effect of an electromagnetic shielding. A shielding function may be added to the element receiving portion 2 when the engine head 51 is not made of a shielding material. Metal (e.g., copper, iron, nickel, aluminum and their alloys) having electric conductivity, through which the radiated noise is passed to ground, or a wave absorber (e.g., magnetic or electromagnetic material) may preferably be used as the material that adds the shielding function to the element receiving portion 2. Additionally, in terms of structurally adding the shielding function to the element receiving portion 2, the shielding material may be attached as a film onto a surface of the element receiving portion 2, or the element receiving portion 2 may be painted with the shielding material. Also, the shielding material, which is formed into a shape of a sheet, may be inserted or attached, or the shielding material may be mixed into a material such as resin or a rubber material, which is formed into the element receiving portion 2.

According to the first embodiment, the electromagnetic-wave noise, which is generated in the discharge power source circuit 300 and is transmitted through the distribution line from the discharge power source circuit 300 to the plasma ignition plug 10, is converted into heat by the resistance element 37 and is absorbed. Because an electric current passing from the discharge power source circuit 300 is restricted by the resistance element 37, and a variation of the current becomes small, the generation of the electromagnetic-wave noise is restricted. Electric discharge is a high frequency phenomenon that is generated instantaneously. Thus, the electromagnetic-wave noise generated due to the current variation generated at the time of electric discharge is promptly absorbed by positioning the resistance element 37 near the electric discharge part, so that the electromagnetic-wave noise reduction effect is enhanced. The variation of electric current is made small by the resistance element 37, and thus a variation of a magnetic field becomes small. Therefore, the electromagnetic-wave noise itself is reduced. By disposing the resistance element 37 in the element receiving portion 2, which is provided in the periphery of the center electrode 110, the electromagnetic-wave noise, which is generated because of the stray capacitance between the electric wire and the ground from the discharge voltage power source 300 to the center electrode 110, is efficiently absorbed. Because electric charges of the stray capacitance flow instantaneously, and the variation of the electric current becomes large, the electromagnetic-wave noise is caused. By inserting the resistance, the current variation due to the amount of the above stray capacitance is restricted, and the electromagnetic-wave noise itself is made small. When the plasma current is discharged, the rectifying device 43 is reversely biased to function as a capacitor for noise absorption, and thus the electromagnetic-wave noise is even further reduced. As a result, extremely stabilized ignition in the internal combustion engine having great ignition resistance by the plasma ignition system 1, which is excellent in the effect of preventing an emission of the electromagnetic-wave noise to the outside, is realized.

Figure 4:
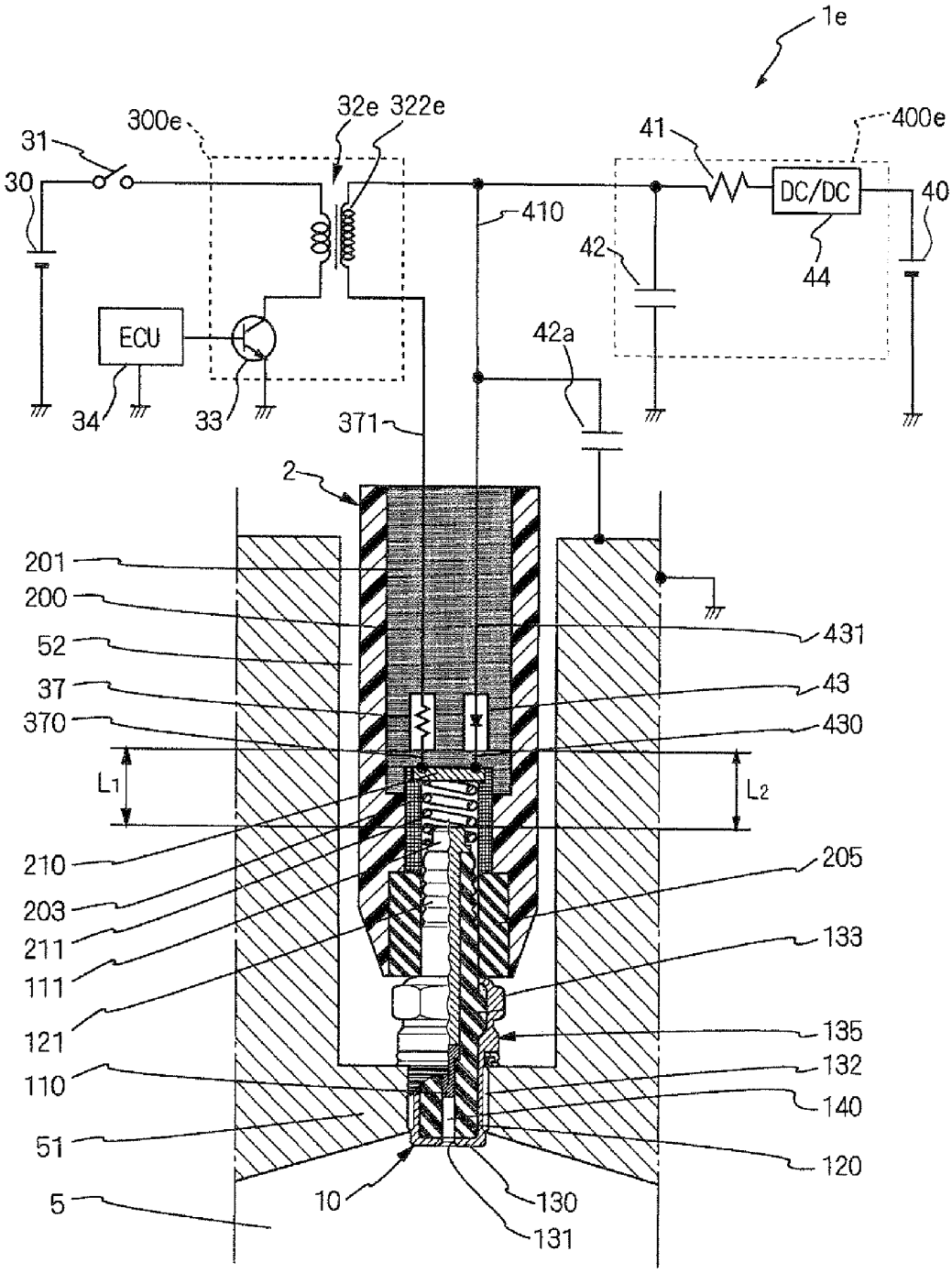
FIG. 4 is a sectional view illustrating a configuration of a main portion of a plasma ignition system according to a second embodiment of the invention.

A plasma ignition system le according to a second embodiment of the invention is explained below with reference to FIG. 4. The second embodiment has the same basic configuration as the first embodiment, and the same numerals are used to indicate the same parts in the description and drawings. The second embodiment is slightly different from the first embodiment in a method of connecting a discharge power source circuit 300*e* and a plasma generation power source circuit 400*e*. In the second embodiment, a secondary coil 322*e* of an ignition coil 32*e* is connected to the plasma generation power source circuit 400*e*, and a rectifying device 43, which rectifies a plasma current, is used also for rectifying a discharge current. By employing such a configuration as well, the effect of reducing the electromagnetic wave noise is produced similar to the first embodiment.

Figure 5:
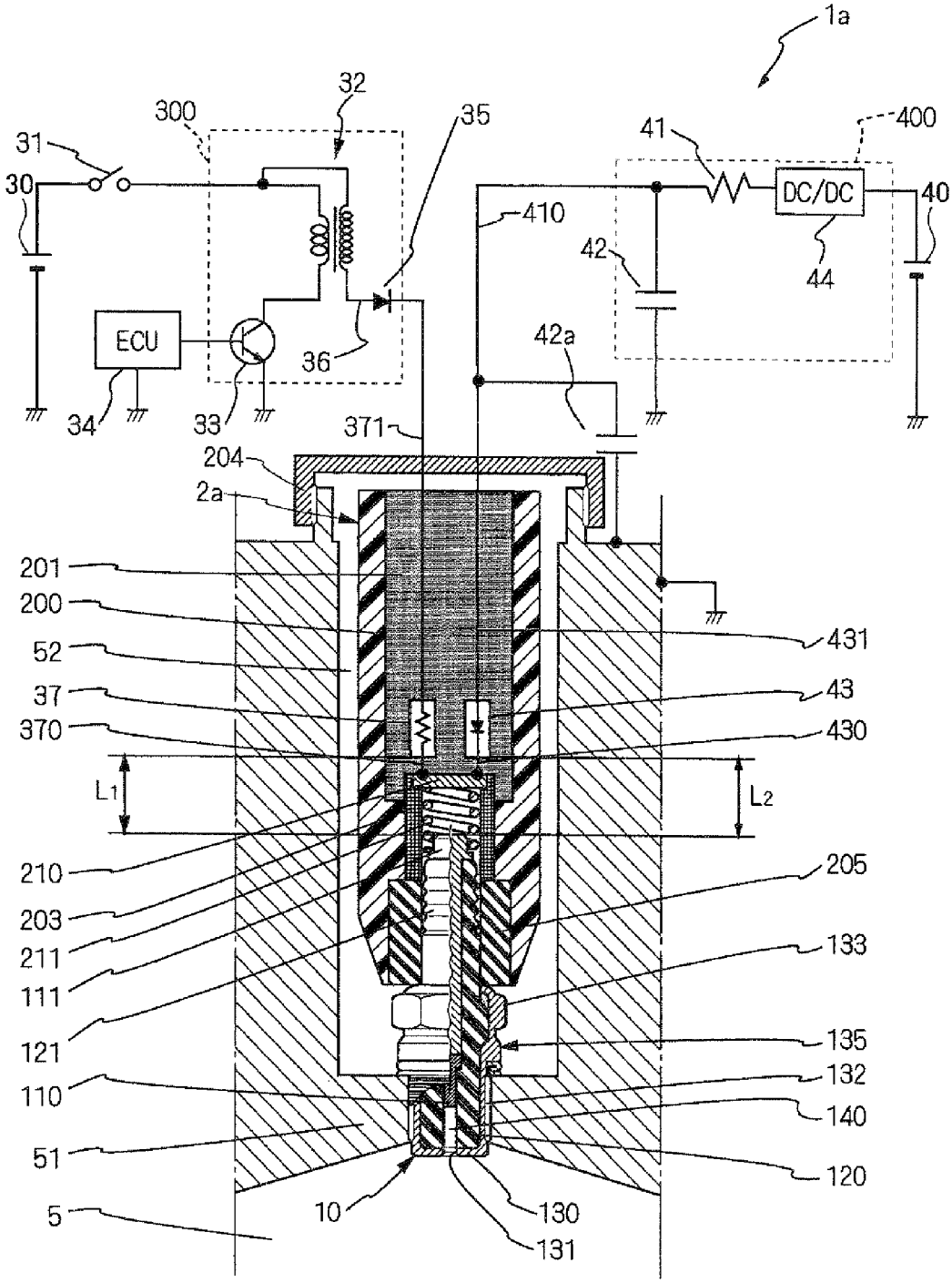
FIG. 5 is a sectional view illustrating a configuration of a main portion of a plasma ignition system according to a third embodiment of the invention.

A plasma ignition system 1*a* according to a third embodiment of the invention is explained with reference to FIG. 5. The plasma ignition system 1*a* of the third embodiment has the same basic configuration as the first embodiment, and the same numerals are used to indicate the same parts in the description and drawings. The third embodiment is different from the first embodiment in that an element receiving portion 2*a* is covered with a shielding member 204. By employing such a configuration, an engine block 51 functions as an electromagnetic shielding, and accordingly an emission of the electromagnetic wave noise to the outside of the plug hole 52 is efficiently restricted.

Figure 6:
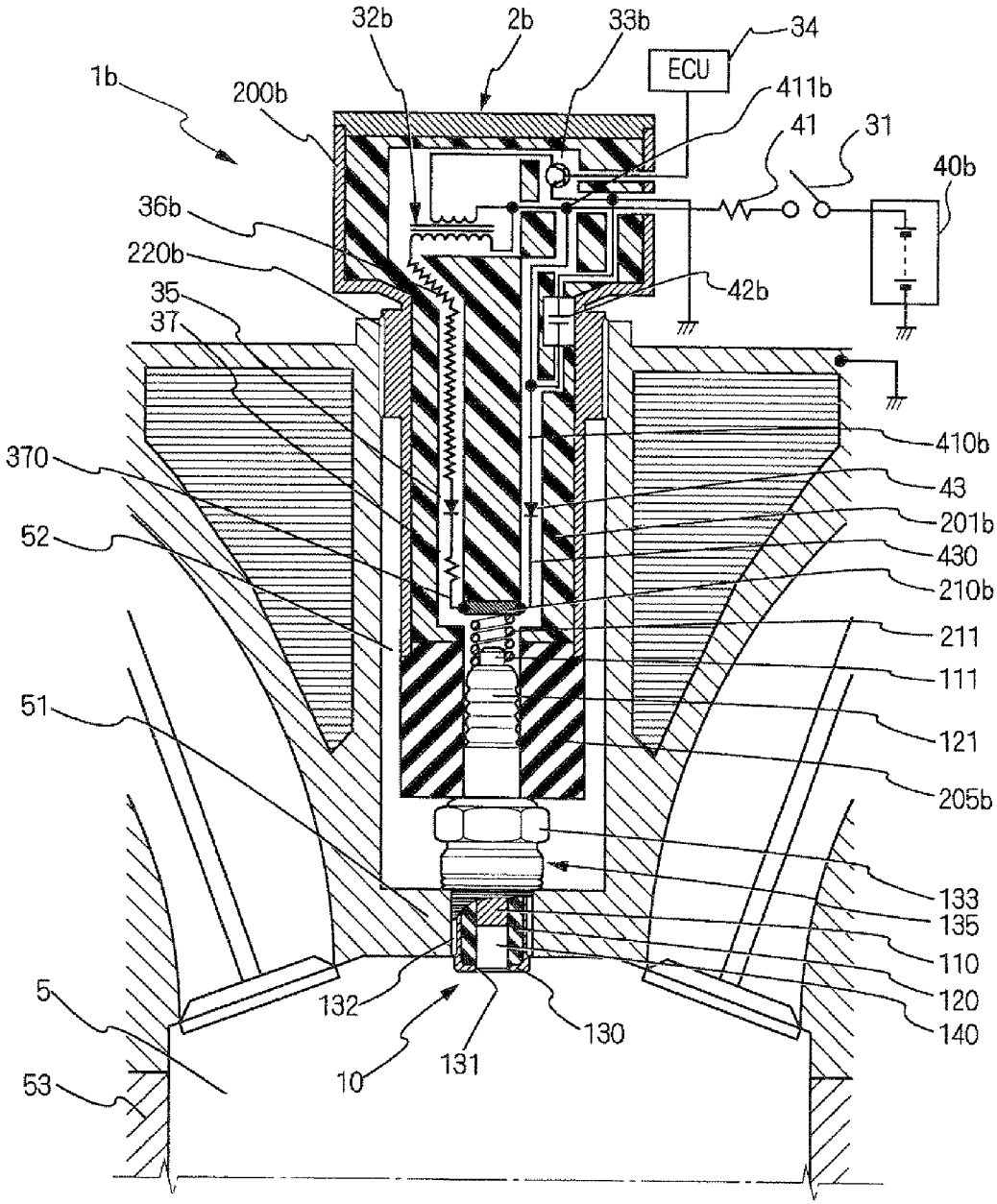
FIG. 6 is a sectional view illustrating a configuration of a main portion of a plasma ignition system according to a fourth embodiment of the invention.

A plasma ignition system 1*b* according to a fourth embodiment of the invention is explained with reference to FIG. 6. Components, which are the same as the above embodiments, are given the same numerals to omit their explanations, and only characteristic components of the plasma ignition system 1*b* of the fourth embodiment are explained. An element receiving portion 2*b*, which is a main portion of the invention, includes an ignition coil drive circuit 33*b*, an ignition coil 32*b*, a rectifying device 35 that rectifies a discharge current, a resistance element 37, a plasma generation capacitor 42*b*, a rectifying device 43 that rectifies a plasma current, an insulating resin molding 201*b* that is made of epoxy resin or the like and covers the above components, an insulated part 205 that is formed in a cylindrical shape from an elastic member so as to be attached on an insulating member head portion 130 of a plasma ignition plug 10, and a first terminal 210*b* that is connected to a center electrode terminal part 111. The whole element receiving portion 2*b* is covered with a case 200*b*, which serves also as an electromagnetic wave shield. The element receiving portion 2*b* is screwed to the inside of a plug hole 52 of an engine block 51 through a case threaded portion 220*b* of the case 200*b*. The whole case 200*b* may be formed from metal. Also, the case 200*b* may be formed by covering some or all of its surface with metal plating after forming the case 200*b* from resin.

The ignition coil drive circuit 33*b* includes a transistor, on which opening and closing control is performed by an electronic control unit (ECU) 34 formed outside the whole element receiving portion 2, so as to control the supply of a high voltage as a result of boosting a voltage from a power source 40*b* through the ignition coil 32*b* to the plasma ignition plug 10.

The plasma generation capacitor 42*b* is charged by the power source 40*b*, and releases the high current to the plasma ignition plug 10 at the time of its electric discharge. In the fourth embodiment, the plasma generation capacitor 42*b* is grounded to the engine block 51, and functions also as a capacitor for electromagnetic wave noise reduction, which bypasses the electromagnetic wave noise generated at the time of the electric discharge to the engine block 51.

A resistance wire 41 is connected between the power source 40 and a contact point 411*b*. A primary side of the ignition coil 32, the plasma generation capacitor 42*b*, and the rectifying device 43, which are connected in parallel at the contact point 411*b*, are connected by a resistance-less line.

Figure 7:
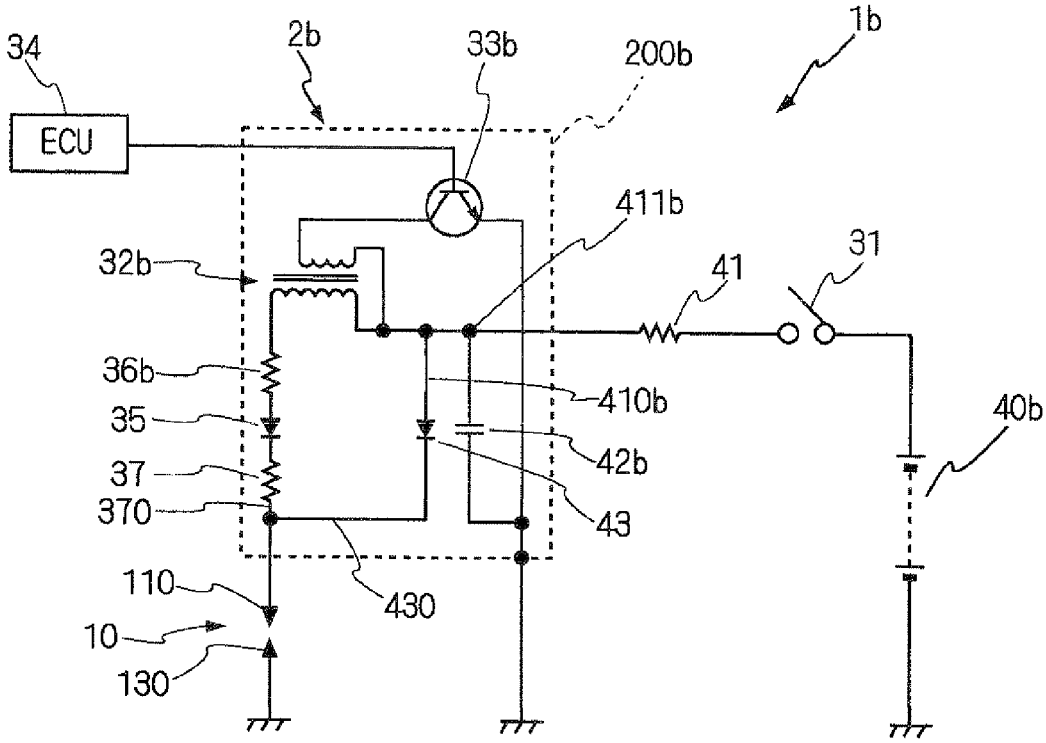
FIG. 7 is a circuit diagram of the plasma ignition system according to the fourth embodiment.

With reference to FIG. 7, a circuit configuration of the plasma ignition system 1*b* of the fourth embodiment of the invention, and an advantageous effect of the invention are explained in full detail. The plasma ignition system 1*b* includes the plasma ignition plug 10, the power source 40*b* and an ignition switch 31, the ignition coil 32*b*, the ignition-coil drive circuit 33*b* having a transistor, the ECU 34, a resistance wire 36*b*, the rectifying device 35, the resistance element 37, the resistance wire 41, the plasma generation capacitor 42*b*, the rectifying device 43, and the element receiving portion 2*b*. A negative side of the power source 40*b* is grounded, and the power source 40*b* is connected such that the center electrode 110 of the plasma ignition plug 10 serves as a positive pole and that the ground electrode 130 serves as a negative pole. The resistance wire 41 is connected between the power source 40 and the contact point 411*b*, and the primary side of the ignition coil 32*b*, the plasma generation capacitor 42*b*, and the rectifying device 43, which are connected in parallel at the contact point 411*b*, are connected by a resistance-less line 410*b*.

The power source 40*b* and the capacitor 42*b* are connected by the resistance wire 41, and the capacitor 42*b* and the center electrode 110 are connected by the resistance-less line.

When electricity is discharged, a high current is supplied from the capacitor 42*b* to the center electrode 110 through the resistance-less line, so that the current value of the high current is not decreased. Furthermore, the electromagnetic-wave noise caused due to charge and discharge repeated between the power source 40*b* and the capacitor 42*b* is absorbed by the resistance wire 41.

The rectifying device 35 is placed in series between a secondary coil of the ignition coil 32*b* and the center electrodes 110 via the high resistance line 36*b*. Furthermore, the resistance element 37 is placed extremely close to the center electrode 110 between the rectifying device 35 and the center electrodes 110. The rectifying device 43 is placed in parallel with the rectifying device 35 between the plasma generation capacitor 42*b* and the center electrodes 110.

The rectifying device 35, the rectifying device 43, the plasma generation capacitor 42*b*, the ignition coil 32*b*, and the ignition coil drive circuit 33*b* are covered with the case 200*b*, and earth side of the plasma generation capacitor 42*b* and the case 200*b* are grounded. A diode is used for the rectifying device 35 and the rectifying device 43. In the fourth embodiment, a resistance wire of 16 kΩ/m is used for the resistance wire 36. A resistance wire, a resistance value of which between the power source 40 and the contact point 411 is constant (e.g., 1 kΩ), is used for the resistance wire 41. A fixed resistance element of 5 kΩ is used for the resistance element 37, and a capacitor having a capacitance of 2 μF is used for the plasma generation capacitor. The resistance value of the resistance element 37 may be set at 3 kΩ or above, or more preferably at 5 kΩ or above. By setting the resistance value of the resistance element 37 in the above range, the generation of the electromagnetic-wave noise is restricted more effectively. A resistance value of the resistance wire 36*b* may be set in a range of 10 to 20 kΩ/m. By setting the resistance value of the resistance wire 36*b* in the above range, the effect of restricting the generation of the electromagnetic-wave noise is enhanced. The resistance value of the resistance wire 41 (connecting the power source 40*b* and the capacitor 42*b*) over its overall length may be set at a predetermined value that is 1 kΩ or above. By setting the resistance value of the resistance wire 41 in the above range, the absorption of the electromagnetic-wave noise is more effectively realized. In addition, if the resistance element 37 is a high resistance of 15 kΩ or higher, it turns out that the electric discharge is not fully performed and thereby ignitionability is affected although the electromagnetic wave noise is restricted. Therefore, 15 kΩ is a threshold limit, below which the electric discharge is fully carried out. Moreover, the resistance value in each cylinder may preferably be the same by using a resistance wire for only a part of wire length of the resistance wire 41 with a length of the above resistance wire being constant with respect to a wiring to each cylinder, and by using a resistance-less electrically conducting wire for the other parts of the resistance wire 41. Meanwhile, a position at which the above resistance wire is used may be on a side close to the plug 10 that is a noise source.

When the ignition switch 31 is thrown, a primary voltage of the power source 40*b* is applied to the primary coil 321 of the ignition coil 32*b* in response to an ignition signal from the ECU 34. Then, when the primary voltage is cut off by the switching of the ignition coil drive circuit 33*b*, a magnetic field in the ignition coil 32*b* changes. Accordingly, due to a self-inductance effect, a positive secondary voltage ranging between 10 and 30 kV is induced in the secondary coil of the ignition coil 32*b*. On the other hand, the plasma generation capacitor 42*b* is connected in parallel with the plasma ignition plug 10, and the plasma generation capacitor 42*b* is charged by the power source 40*b*.

When the secondary voltage applied to the secondary coil exceeds a discharge voltage between the center electrode 110 and the ground electrode 130, electric discharge is started between the both electrodes, and accordingly gas in the discharge space 140 enters into a plasma state in a small region. The above gas in the plasma state has conductivity, so that electric charge stored between both poles of the plasma generation capacitor 42*b* is discharged. As a result, the gas in the discharge space 140 enters further into the plasma state, and the region in the plasma state is expanded The gas in the plasma state has high temperature and pressure, and is injected into the engine.

Meanwhile, the electromagnetic wave noise is generated. However, by disposing the rectifying device 35, the rectifying device 43, and the plasma generation capacitor 42*b* as close to the center electrode 110 as possible, only a noise current having a high frequency generated in discharging electric charge is bypassed through the plasma generation capacitor 42*b* (functioning as a noise absorption capacitor) with the element receiving portion 2*b* as a ground, without attenuation of the discharge voltage from the ignition coil 32*b*. Thus, the electromagnetic wave noise, which is generated in releasing a plasma current, is prevented from being transmitted to the outside of the element receiving portion 2*b*. Moreover, a high current delivery line 430 which connects the plasma generation capacitor 42*b* and the center electrode 110 is extremely shortened. Accordingly, the high current delivery line 430 does not serve as an antenna. Thus, even if the electromagnetic wave noise is generated, the noise is prevented from being transmitted to the outside of the element receiving portion 2*b*. Therefore, in the engine having great ignition resistance, stabilized ignition by the plasma ignition system 1*b* is realized.

In addition, the ignition coil 32*b* and the ignition coil drive circuit 33*b* are disposed in the element receiving portion 2*b*, and a discharge delivery line (resistance wire) 36*b*, which connects the ignition coil 32*b* and the center electrode 110, is shortened. Consequently, the discharge delivery line 36*b* does not serve as an antenna, so that the transmission of the electromagnetic wave noise to the outside is prevented. Furthermore, the engine block 51 (or the plug hole 52) functions as an electromagnetic wave shield to receive a noise source comprehensively in the plug hole 52. As a result, leakage of the electromagnetic wave noise from the plug hole 52 is prevented (or the plug hole 52 absorbs the noise). Even when the plug hole 52 is formed from a member whose function as electromagnetic shielding is small, the element receiving portion 2*b* itself functions as electromagnetic shielding by covering the element receiving portion 2*b* with a metallic material, or by mixing a magnetic material into the element receiving portion 2*b*, and the electromagnetic-wave noise is further absorbed. In the fourth embodiment, by using a booster power source in which the voltage of the power source 40*b* is boosted beforehand, the ignition coil 32*b* is downsized, and thereby installability of the plasma ignition system 1 is further improved.

The discharge power source circuit includes the ignition coil 32*b* (boosting means) which boosts the supply voltage and the rectifying device 35, and the rectifying device 35 is placed in the element receiving portion 2*b*.

At the time of electric discharge, the rectifying device 35 is reversely biased to function as a capacitor. Thus, the electromagnetic-wave noise is further reduced. As a result, in the internal combustion engine having great ignition resistance, ignition by the plasma ignition system 1*b* is further stabilized. Furthermore, by placing the rectifying device 35, the rectifying device 43, and the plasma generation capacitor 42*b* in the element receiving portion 2*b*, the plasma ignition plug 10 is easily installed in the engine without upsizing the plasma ignition plug 10 so much. Therefore, in the internal combustion engine having great ignition resistance, stabilized ignition by the plasma ignition system 1*b* is realized.

The discharge power source circuit includes the ignition coil 32*b* as the boosting means and the ignition-coil drive circuit 33*b* which drives the ignition coil 32*b*, and the ignition coil 32*b* is placed in the element receiving portion 2*b*.

Since the discharge high voltage supply line, which connects the ignition coil 32*b* and the center electrode 110, is shortened, the discharge high voltage supply line does not serve as an antenna, and thus the electromagnetic-wave noise is prevented from being transmitted from the outside of element receiving portion 2*b*. By receiving the noise source comprehensively within a definite range, the electromagnetic-wave noise is efficiently enclosed in the element receiving portion 2*b*. By receiving the ignition coil 32*b* in the element receiving portion 2*b* as well, the electromagnetic wave noise source and the components connected to the noise source are integrally and compactly received. Accordingly, the effect of reducing the electromagnetic-wave noise is made great. Furthermore, the plasma ignition system 1*b* is easily installed in the engine without upsizing the system 1*b* so much.

The ignition coil 32*b* and the rectifying device 35 are connected by the resistance wire 36*b*.

Accordingly, the electromagnetic-wave noise, which is generated due to a variation of the current value between the ignition coil 32*b* and the rectifying device 35, is absorbed by the resistance wire 36*b*.

Figure 8:
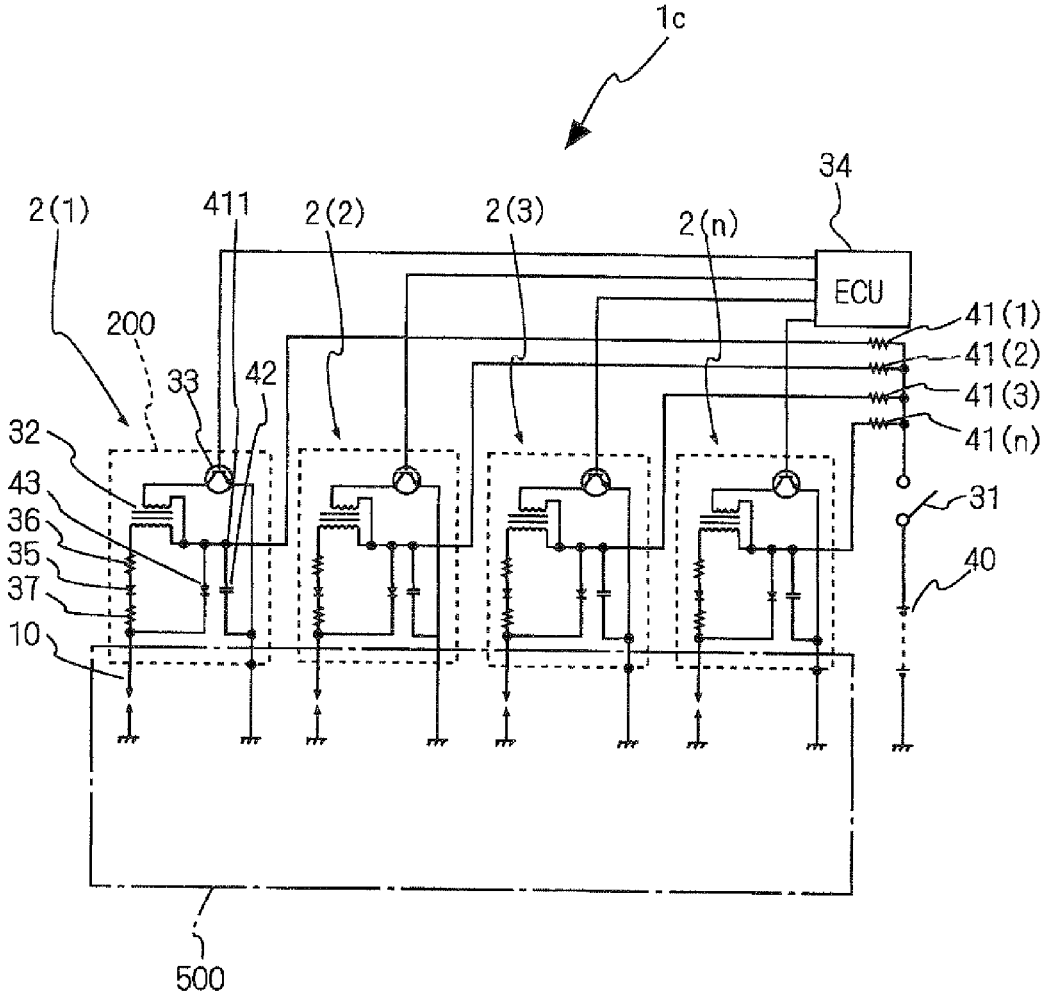
FIG. 8 is a circuit diagram of the plasma ignition system according to a fifth embodiment of the invention.

FIG. 8 shows a configuration of a plasma ignition system 1*c* according to a fifth embodiment of the invention, in which the plasma ignition plugs 10 are used in an internal combustion engine 500 having a plurality of cylinders. Since the same numerals are used in FIG. 8 for indicating the same components as those in the fifth embodiment, their descriptions are omitted. In the fifth embodiment, in addition to the effect shown in the fourth embodiment, additional electromagnetic wave noise due to a electric potential difference between the element receiving portions is not generated, because a plurality of element receiving portions 2 (1 to n) are formed from a case 200 having a given shape so that their stray capacitances and earth potentials are constant. Therefore, stabilized ignition by the plasma ignition system 1*c* is realized in the internal combustion engine 500 of poor ignitionability including the plurality of cylinders. In addition, in the fifth embodiment, the plasma ignition system 1*c* is wired using a resistance wire and a resistance-less line such that each resistance value of resistance wires 41 (1 to n) is constant. Even if a wiring length to each cylinder is different in the circuit, the resistance value of the overall length of the resistance wire is made generally the same for each wiring. Thus, a resistance value of the wiring to each cylinder per its unit length may differ. By making only a part of each wire length a resistance wire, making a length of the resistance wire constant with respect to a wiring to each cylinder, and making the other parts of each wire length a resistance-less electric wire, the resistance value may be the same for each cylinder. In such a case, the resistance wire may be used on a side near the plug 10 as a noise source.

A variation of the resistance values of resistance wires may be set in a range of ±100Ω.

Accordingly, more effective absorption of the electromagnetic-wave noise is realized. When the invention is applied to the internal combustion engine having two or more cylinders, differences between ground potentials become small and additional generation of the electromagnetic-wave noise is prevented, since differences between the resistance wires are small.

Figure 9:
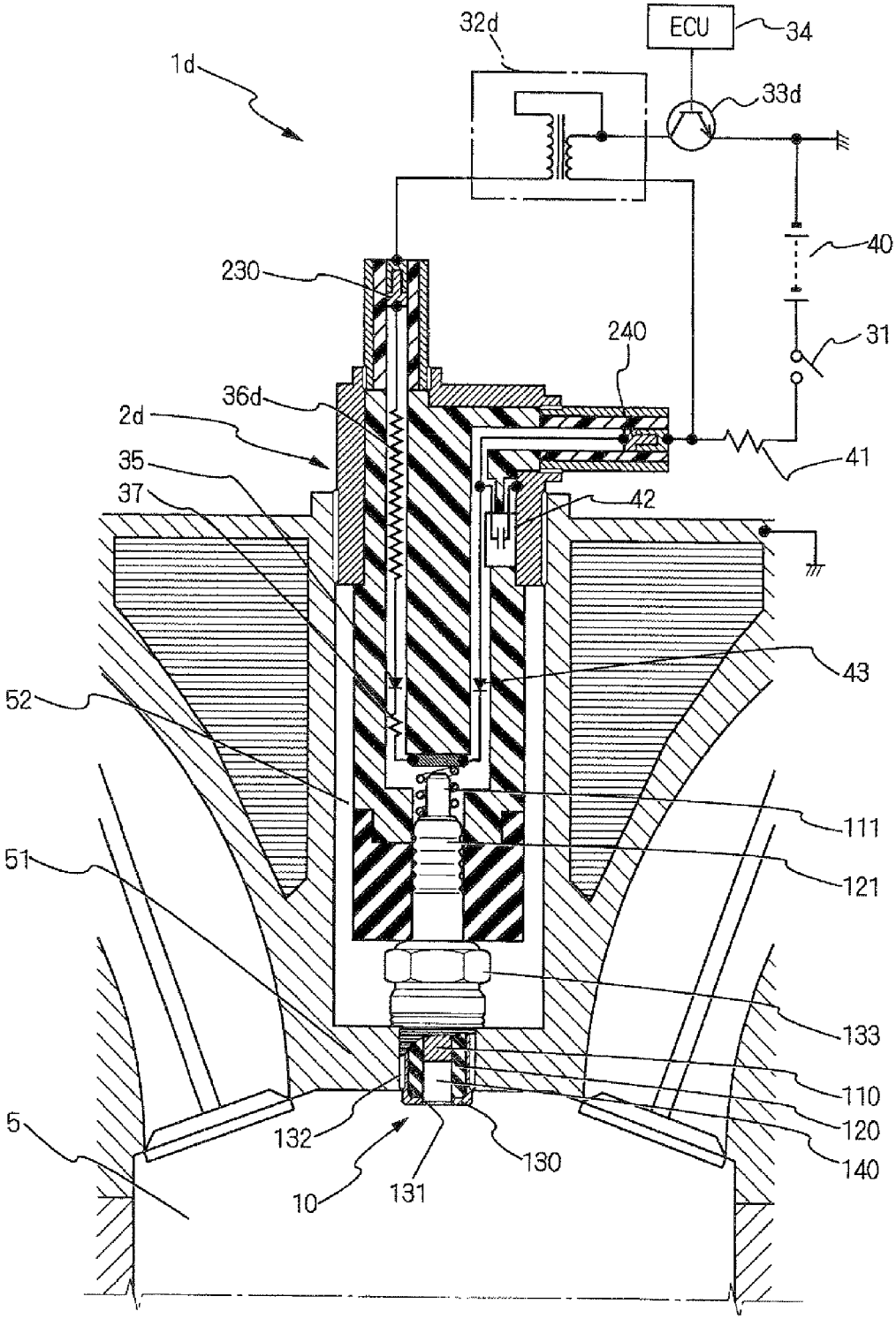
FIG. 9 is a sectional view illustrating a configuration of a main portion of a plasma ignition system according to a sixth embodiment of the invention.
Figure 10A:
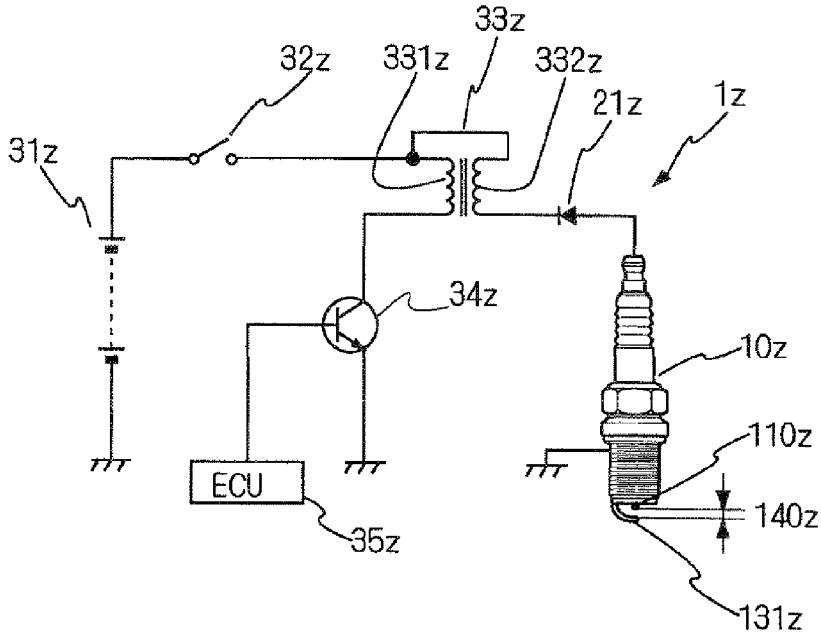
FIG. 10A RELATED ART
FIG. 10A is a circuit diagram illustrating a configuration of an ordinary spark plug.
Figure 10B:
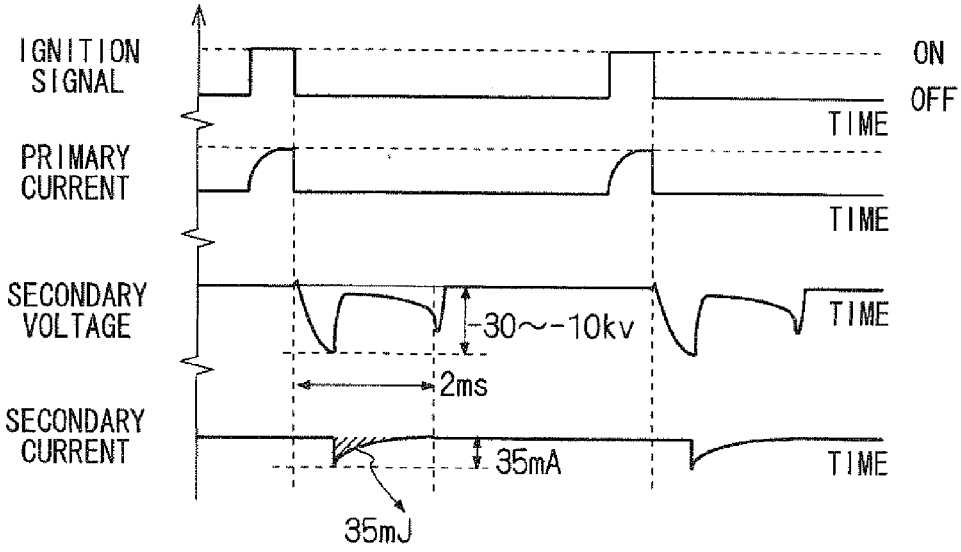
FIG. 10B RELATED ART
FIG. 10B is an operating characteristic graph illustrating operating waveforms in FIG. 10A.
Figure 11:
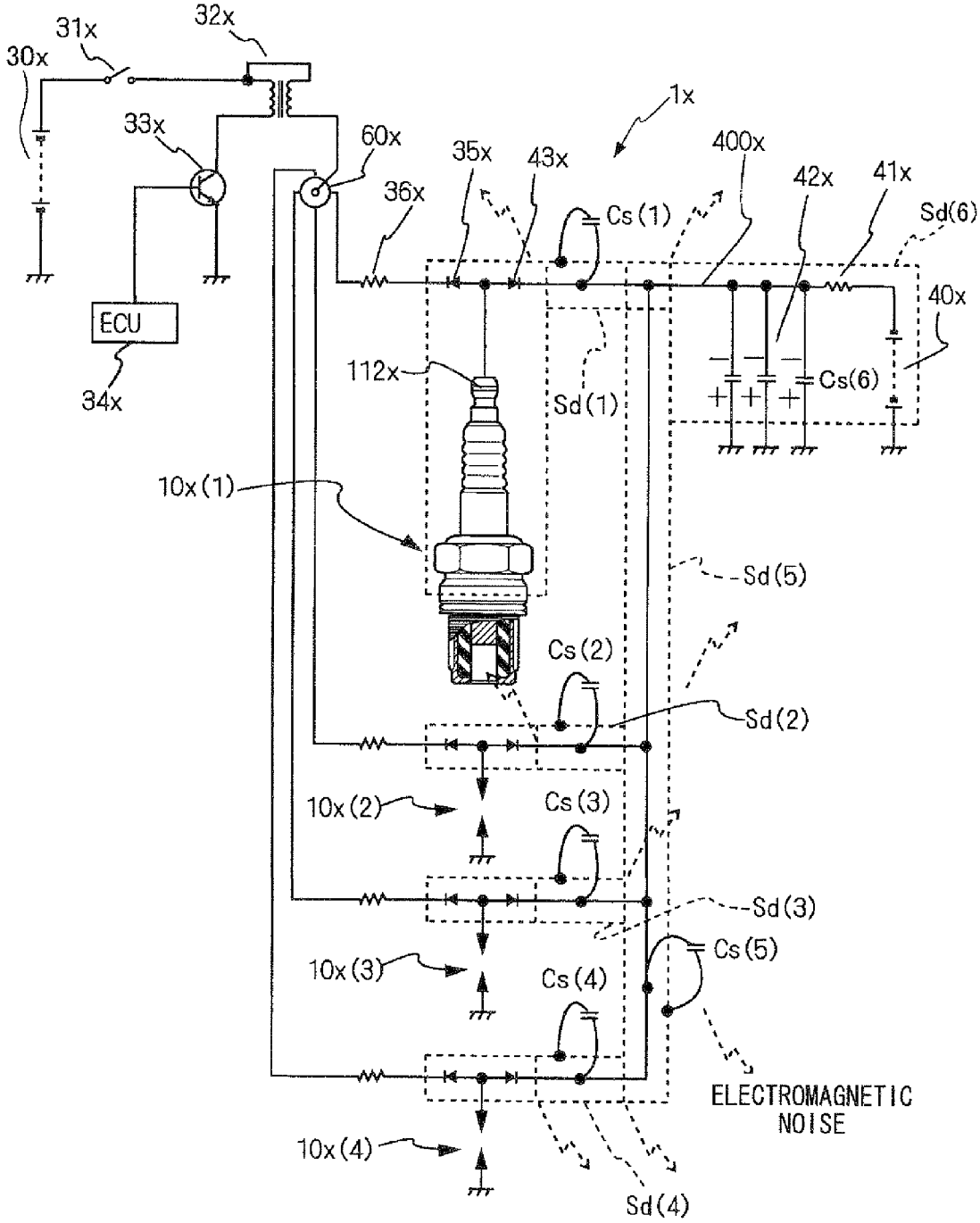
FIG. 11 PRIOR ART
FIG. 11 is a circuit diagram illustrating a configuration and a problem of a previously proposed plasma ignition system installed in an internal combustion engine having a plurality of cylinders.
Figure 12A:
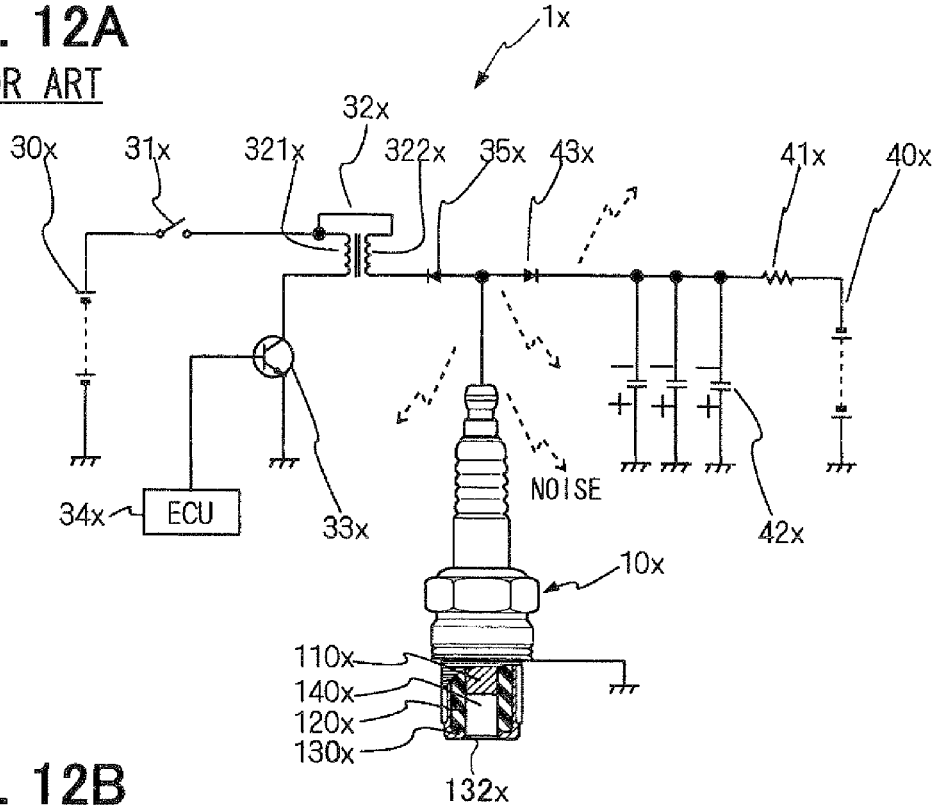
FIG. 12A PRIOR ART
FIG. 12A is a circuit diagram illustrating a configuration of a previously proposed plasma ignition system.
Figure 12B:
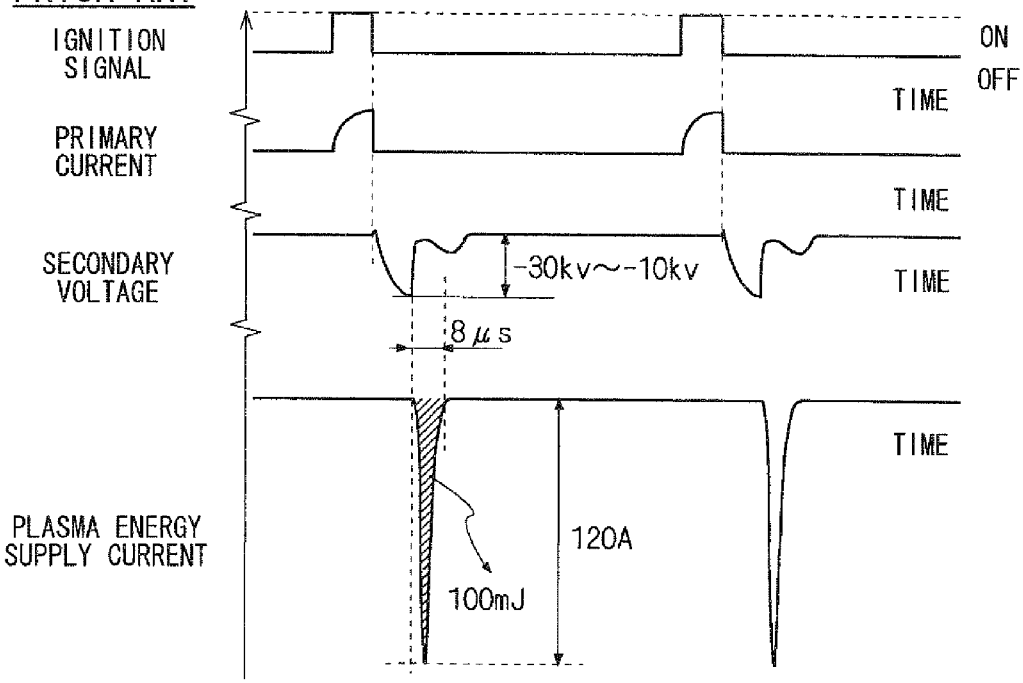
FIG. 12B PRIOR ART
FIG. 12B is an operating characteristic graph illustrating operating waveforms in FIG. 12A.

FIG. 9 is a schematic view illustrating a plasma ignition system 1*d* according to a sixth embodiment of the invention. Although the sixth embodiment has a similar basic configuration to the fourth embodiment, it is different from the fourth embodiment in the following respects (since the same numerals are used in FIG. 9 for indicating the same components as those in the fourth embodiment, and thus their descriptions are omitted). That is, an ignition coil 32*d* and an ignition coil drive circuit 33*d* are disposed outside an element receiving portion 2*d*. Furthermore, a second terminal part 230 is provided for connecting the ignition coil 32*d* and the element receiving portion 2*d*, and a third terminal 240 is provided for connecting a power source 40 and the element receiving portion 2*d*. In addition, the second terminal part 230 and the third terminal 240 are disposed to be perpendicular to each other.

In order to prevent leakage of an electromagnetic wave noise to the outside of the receiving portion 2*d*, it is necessary that the electromagnetic wave noise should not be applied between a plasma generation capacitor 42 and the third terminal part 240. In the sixth embodiment, the plasma generation capacitor 42 is distanced from a rectifying device 35 that rectifies a discharge current and its wiring 36*d*, in which the electromagnetic wave noise is generated, and the second terminal part 230 is separated from the third terminal part 240. It turns out that generation of the electromagnetic wave noise is further reduced by disposing the plasma generation capacitor 42 near the third terminal 240. Furthermore, by placing the plasma generation capacitor 42 away from the second terminal part 230, the leakage of a high voltage for electric discharge applied to the second terminal part 230 to the plasma generation capacitor 42 is prevented. In addition, the element receiving portion 2*d* is formed have a simple shape, and is thereby easy to produce, having very high usefulness.

The invention is not limited to the above embodiments, and is suitably modified without departing from the scope of the invention. For example, in the above embodiments, the plasma ignition plug 10, in which the electric discharge is performed between the center electrode and the ground electrode in the discharge space formed inside the insulating member covering the center electrode, is employed as an ignition plug. Nevertheless, the plasma ignition system of the invention may be applied appropriately to a spark plug, which discharges electricity into an air gap between a center electrode and a ground electrode, or to a creeping discharge plug, which discharges electricity on a dielectric surface, as an ignition plug.

Additional advantages and modifications will readily occur to those skilled in the art. The invention in its broader terms is therefore not limited to the specific details, representative apparatus, and illustrative examples shown and described.

What is claimed is:

1. A plasma ignition system for an internal combustion engine, said system comprising:

an ignition plug attached to the engine and having a center electrode, a ground electrode, and a discharge space, which is formed between the center electrode and the ground electrode;

a discharge power source circuit configured to apply a high voltage to the ignition plug;

a plasma generation power source circuit configured to supply a high current to the ignition plug, wherein the ignition plug is configured to put gas in the discharge space into a plasma state having high temperature and pressure thereby to ignite a fuel/air mixture in the engine, as a result of the application of the high voltage to the ignition plug by the discharge power source circuit and the supply of the high current to the ignition plug by the plasma generation power source circuit;

a resistance element disposed and electrically connected along a first line between the discharge power source circuit and the center electrode;

a rectifying device disposed and electrically connected along a second line between the plasma generation power source circuit and the center electrode, the first and second lines being arranged parallel to each other and with respect to the center electrode; and an element receiving portion disposed about a periphery of the center electrode, wherein the resistance element and the rectifying device are disposed in the element receiving portion;

wherein at least part of the element receiving portion is placed in a plug hole formed in an engine block of the engine;

the resistance element and the rectifying device are located in the plug hole of the engine block;

the gas, which is put into the plasma state, is injected downward in a vertical direction from the ignition plug into a combustion chamber of the engine;

a first distance from a lower end portion of the resistance element to an upper end portion of the center electrode in the vertical direction is equal to or smaller than 30 mm; and a resistance value of the resistance element is one of:

(a) equal to or larger than 3 kΩ, and smaller than 15 kΩ; and (b) equal to or larger than 5 kΩ, and smaller than 15 kΩ.

2. The plasma ignition system according to claim 1, wherein:

the gas, which is put into the plasma state, is injected downward in a vertical direction from the ignition plug into a combustion chamber of the engine; and a second distance from a lower end portion of the rectifying device to an upper end portion of the center electrode in the vertical direction is equal to or smaller than 30 mm.

3. The plasma ignition system according to claim 1, wherein:

the gas, which is put into the plasma state, is injected downward in a vertical direction from the ignition plug into a combustion chamber of the engine; and a total distance of a first distance from a lower end portion of the resistance element to an upper end portion of the center electrode in the vertical direction and a second distance from a lower end portion of the rectifying device to an upper end portion of the center electrode in the vertical direction is equal to or smaller than 30 mm.

4. The plasma ignition system according to claim 1, wherein:

the gas, which is put into the plasma state, is injected downward in a vertical direction from the ignition plug into a combustion chamber of the engine; and the resistance element and the rectifying device are arranged side by side with each other above the center electrode in the vertical direction.

5. The plasma ignition system according to claim 1, wherein the element receiving portion is formed to block an opening of a plug hole formed in an engine block of the engine.

6. The plasma ignition system according to claim 1, wherein the element receiving portion includes a radio wave absorbent, which is made of one of a metallic material and a magnetic material.

7. The plasma ignition system according to claim 1, further comprising a power source, wherein:

the plasma generation power source circuit includes a plurality of capacitors, which are charged by the power source; and one of a part and whole of the plurality of capacitors is placed in the element receiving portion.

8. The plasma ignition system according to claim 7, wherein:

the power source and the plurality of capacitors are connected by a resistance wire; and the plurality of capacitors and the center electrode are connected by a resistance less wire.

9. The plasma ignition system according to claim 8, wherein a resistance value of the resistance wire along an entire length of the resistance wire is set at a predetermined value, which is equal to or larger than 1 kΩ.

10. The plasma ignition system according to claim 1, further comprising a power source, wherein the discharge power source circuit includes:

a boosting means for boosting a voltage of the power source; and a rectifying device configured to rectify a discharge current and placed in the element receiving portion.

11. The plasma ignition system according to claim 10, wherein the boosting means and the rectifying device are connected by a resistance wire.

12. The plasma ignition system according to claim 11, wherein a resistance value of the resistance wire is in a range of 10 to 20 kΩ/m.

13. The plasma ignition system according to claim 11, wherein:

the plasma generation power source circuit includes a plurality of capacitors, which are charged by a power source; and differences among resistance values of a resistance wire, which connects the power source and the plurality of capacitors, are within a range of −1000 to 1000.

14. The plasma ignition system according to claim 1, further comprising a power source, wherein the discharge power source circuit includes:

an ignition coil placed in the element receiving portion and serving as a boosting means for boosting a voltage of the power source; and an ignition coil drive circuit configured to drive the ignition coil.

15. The plasma ignition system according to claim 1, further comprising a power source, wherein:

the discharge power source circuit includes a boosting means for boosting a voltage of the power source; and the boosting means and the resistance element are connected by a resistance wire, which is placed in the element receiving portion.

16. The plasma ignition system according to claim 15, wherein:

the discharge power source circuit further includes a rectifying device, which is configured to rectify a discharge current and is disposed between the resistance wire and the resistance element in the element receiving portion;

the boosting means and the rectifying device are connected by the resistance wire; and the resistance element is disposed close to the center electrode between the rectifying device and the center electrodes.

17. The plasma ignition system according to claim 1, wherein the element receiving portion is generally cylindrical and is unbranched.

* * * * *